US008346130B2

(12) United States Patent
Handa et al.

(10) Patent No.: US 8,346,130 B2
(45) Date of Patent: Jan. 1, 2013

(54) IMAGE FORMING APPARATUS AND A METHOD OF CLEANING PHOTOSENSITIVE DRUM SURFACE

(75) Inventors: Hiroshi Handa, Nagoya (JP); Kumiko Suzuki, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 235 days.

(21) Appl. No.: 12/891,869

(22) Filed: Sep. 28, 2010

(65) Prior Publication Data

US 2011/0158692 A1 Jun. 30, 2011

(30) Foreign Application Priority Data

Dec. 25, 2009 (JP) ..... 2009-294599

(51) Int. Cl.
*G03G 15/30* (2006.01)
*G03G 15/00* (2006.01)

(52) U.S. Cl. ..... 399/149; 399/71; 399/167

(58) Field of Classification Search ..... 399/71, 399/149, 167
See application file for complete search history.

(56) References Cited

U.S. PATENT DOCUMENTS 7,493,071 B2 2/2009 Takami
7,567,764 B2 * 7/2009 Yamanaka et al. ..... 399/53
7,702,266 B2 * 4/2010 Kazaki et al. ..... 399/279
2002/0098013 A1 7/2002 Kamimura
2006/0140683 A1 6/2006 Takami

FOREIGN PATENT DOCUMENTS

JP HEI04-221977 A 8/1992
JP HEI09-197917 A 7/1997
JP HEI11-052789 A 2/1999
JP 2002-215002 A 7/2002
JP 2003-167489 A 6/2003
JP 2004-085867 A 3/2004
JP 2004-184934 A 7/2004
JP 2002-304103 A 10/2005
JP 2006-184556 A 7/2006
JP 2007-187814 A 7/2007
JP 2007-322833 A 12/2007

OTHER PUBLICATIONS

JP Reasons for Rejection dated Oct. 18, 2011, corresponding Application No. 2009-294599, English Translation.
JP Decision to Grant mailed May 8, 2012, JP Application No. 2009-294599, partial English Translation.

* cited by examiner

*Primary Examiner* — Hoang Ngo
(74) *Attorney, Agent, or Firm* — Banner & Witcoff, Ltd.

(57) ABSTRACT

An image forming apparatus is configured to execute the steps including: a step of controlling a photosensitive drum and a developing roller such that the developing roller rotates in a predetermined direction and the photosensitive drum rotates in a reverse direction; and a step of controlling the photosensitive drum and the developing roller such that the developing roller stops and the photosensitive drum rotates in the reverse direction, so as to reduce toner filming.

9 Claims, 6 Drawing Sheets

IMAGE FORMING APPARATUS AND A METHOD OF CLEANING PHOTOSENSITIVE DRUM SURFACE

CROSS REFERENCE TO RELATED APPLICATION

This application claims priority from Japanese Patent Application No. 2009-294599, filed on Dec. 25, 2009, the entire subject matter of which is incorporated herein by reference.

FIELD

Aspects of the disclosure relate to an electrophotographic image forming apparatus including a photosensitive drum and a method of cleaning a peripheral surface of the photosensitive drum.

BACKGROUND

A known electrophotographic image forming apparatus includes a photosensitive drum and a developing roller. Along with the rotation of the photosensitive drum, an electrostatic latent image is formed on a peripheral surface of the photosensitive drum, and toner is supplied from the developing roller to the surface of the photosensitive drum.

This develops the electrostatic latent image to a toner image, and the toner image is carried on the surface of the photosensitive drum. The toner image is transferred from the surface of the photosensitive drum to a recording medium, e.g. a recording sheet, thereby the toner image is formed or printed on the recording medium.

In such an image forming apparatus, toner may remain on the photosensitive drum after toner image has been transferred to the recording sheet, and fixedly adhere to the surface of the photosensitive drum. This is a phenomenon called toner filming. Especially in a structure where the surface of the developing roller contacts the surface of the photosensitive drum, toner filming is likely to occur because toner carried on the surface of the developing roller slides on photosensitive drum. Toner filming may result in deterioration of image quality and short lifetime of the photosensitive drum.

SUMMARY

Aspects of the disclosure provide an image forming apparatus which reduces the toner filming and a method of cleaning the surface of the photosensitive drum.

The image forming apparatus is configured to execute the steps including: a step of controlling a photosensitive drum and a developing roller such that the developing roller rotates in a predetermined direction and the photosensitive drum rotates in a reverse direction; and a step of controlling the photosensitive drum and the developing roller such that the developing roller stops and the photosensitive drum rotates in the reverse direction, so as to reduce toner filming.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings.

The general structure of an illustrative printer 1 as an example of an image forming apparatus according to illustrative aspects of the disclosure will be described with reference to FIG. 1.

For ease of discussion, in the following description, the top or upper side, the bottom or lower side, the left or left side, the right or right side, the front or front side, and the rear or rear side are used to define the various parts when the image forming apparatus 1 is disposed in an orientation in which it is intended to be used. In FIG. 1, the left side is referred to as the front or front side, the right side is referred to as the rear or the rear side, the up side is referred to as the top or upper side, and the down side is referred to as the bottom or lower side.

Figure 1:
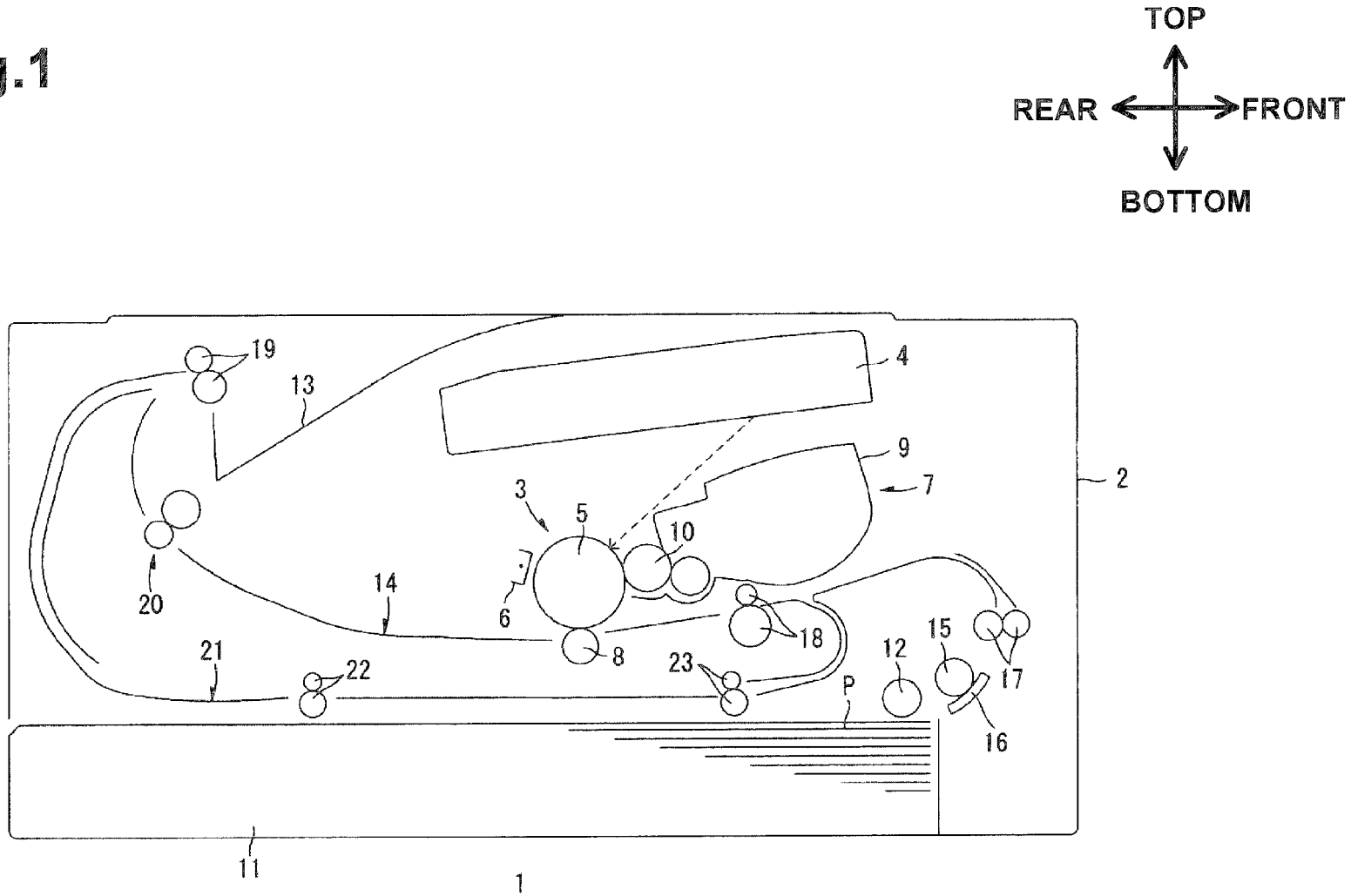
FIG. 1 is a central cross sectional view of a printer as an example of an image forming apparatus using features described herein.

As shown in FIG. 1, the printer 1 includes a body casing 2, a process unit 3 and an exposure unit 4 including a laser emitting unit, for example. The process unit 3 is disposed in a central portion of the body casing 2. The exposure unit 4 is disposed above the process unit 3.

The process unit 3 includes a photosensitive drum 5, a charger 6, a developing unit 7, and a transfer roller 8.

The photosensitive drum 5 is disposed rotatably on an axis extending in a direction perpendicular to a sheet of FIG. 1.

The charger 6 is of a scorotron type, and is spaced apart from and opposite to a peripheral surface of the photosensitive drum 5.

The developing unit 7 includes a developer casing 9 storing toner and a developing roller 10 rotatably supported in the developer casing 9. The developing roller 10 is partially exposed from the developer casing 9. The developing unit 7 is disposed such that a peripheral surface of the developing roller 10 contacts the surface of the photosensitive drum 5.

The transfer roller 8 is disposed rotatably on an axis parallel to the axis of the photosensitive drum 5 and arranged such that a peripheral surface of the transfer roller 8 contacts the surface of the photosensitive drum 5 from below.

During image formation, the photosensitive drum 5 is controlled to rotate at a constant speed in a clockwise direction in FIG. 1. Along with rotation of the photosensitive drum 5, the surface of the photosensitive drum 5 is charged uniformly at a constant positive potential, e.g., +800V, due to an electrostatic discharge from the charger 6. Based on image data received from a personal computer (not shown) connected to the printer 1, the exposure device 4 emits a laser beam onto the surface of the photosensitive drum 5, which is disposed between the charger 6 and the developing unit 7 and positively and uniformly charged. In this manner, the surface of the photosensitive drum 5 is selectively exposed, electrical charge is selectively removed from the exposed area, and an electrostatic latent image is formed on the surface of the photosensitive drum 5.

The developing roller 10 is subjected to the application of a positive bias for developing, e.g. +300V. When the photosensitive drum 5 rotates such that the electrostatic latent image is facing the developing roller 10, toner positively charged is supplied from the developing roller 10 to the electrostatic latent image due to a difference in potential between the electrostatic latent image (from which electrical charge has been removed due to exposure) and the developing roller 10. As a result, a toner image is formed on the surface of the photosensitive drum 5.

A sheet supply cassette 11 is disposed in a bottom portion of the body casing 2. The sheet supply cassette 11 is configured to store a stack of sheets. A pickup roller 12 is disposed above the sheet supply cassette 11. The pickup roller 12 is configured to pickup a sheet from the sheet supply cassette 11.

A conveyance path 14 having an S shape in side view is formed in the body casing 2. The conveyance path 14 is formed from the sheet supply cassette 11 to an output tray 13 formed on the top surface of the body casing 2. The conveyance path 14 passes between the photosensitive drum 5 and the transfer roller 8. On the conveyance path 14, a separation roller 15 and a separation pad 16, a pair of sheet supply rollers 17, a pair of registration rollers 18, and a pair of ejection rollers 19 are provided opposite each other.

A few sheets P fed from the sheet supply cassette 11 are singly separated when passing between the separation roller 15 and the separation pad 16. The sheet P separated by the separation roller 15 and the separation pad 16 is fed to the registration rollers 18 where skew of the sheet P is corrected. The sheet P of which skew is corrected is fed between the photosensitive drum 5 and the transfer roller 8.

The transfer roller 8 is subjected to the application of a minus negative bias, e.g. −1000V. When facing the sheet P, which passes between the photosensitive drum 5 and the transfer roller 8 along with rotation of the photosensitive drum 5, toner image on the surface of the photosensitive drum 5 is electrically attracted by the transfer roller 8 and transferred onto the sheet P.

On the conveyance path 14, a fixing unit 20 is disposed downstream from the transfer roller 8 in a direction in which the sheet P is fed. The sheet P with the toner image is fed through the conveyance path 14 and passes through the fixing unit 20. In the fixing unit 20, the toner image is fixed, as an image, onto the sheet P through the application of heat and pressure.

The printer 1 has a single-sided printing mode where an image is formed on a single side of the sheet P and a double-sided printing mode where an image is formed on both sides of the sheet P.

In the single-sided mode, the sheet P having an image on one side is ejected to the output tray 13 by the ejection rollers 19.

As a structure to realize the double-sided mode, a reverse conveyance path 21 is formed in the body casing 2. The reverse conveyance path 21 starts from the proximity of the ejection rollers 19, extends between the conveyance path 14 and the sheet supply cassette 11, and joins the conveyance path 14 between the sheet supply rollers 17 and the registration rollers 18. On the reverse conveyance path 21, a pair of first bidirectional rollers 22 and a pair of second bidirectional rollers 23 are provided.

In the double-sided mode, after an image is formed on one side of the sheet P, the sheet P is fed into the reverse conveyance path 21 without being fed to the output tray 13. The sheet P is fed through the reverse conveyance path 21 by the first and second bidirectional rollers 21 and 22 such that it is flipped over, and fed to the conveyance path 14 with the other side of the sheet P facing the surface of the photosensitive drum 5. An image is formed on the other side of the sheet P thereby image formation onto both sides of the sheet P is completed.

An electrical structure of the printer 1 will be described.

Figure 2:
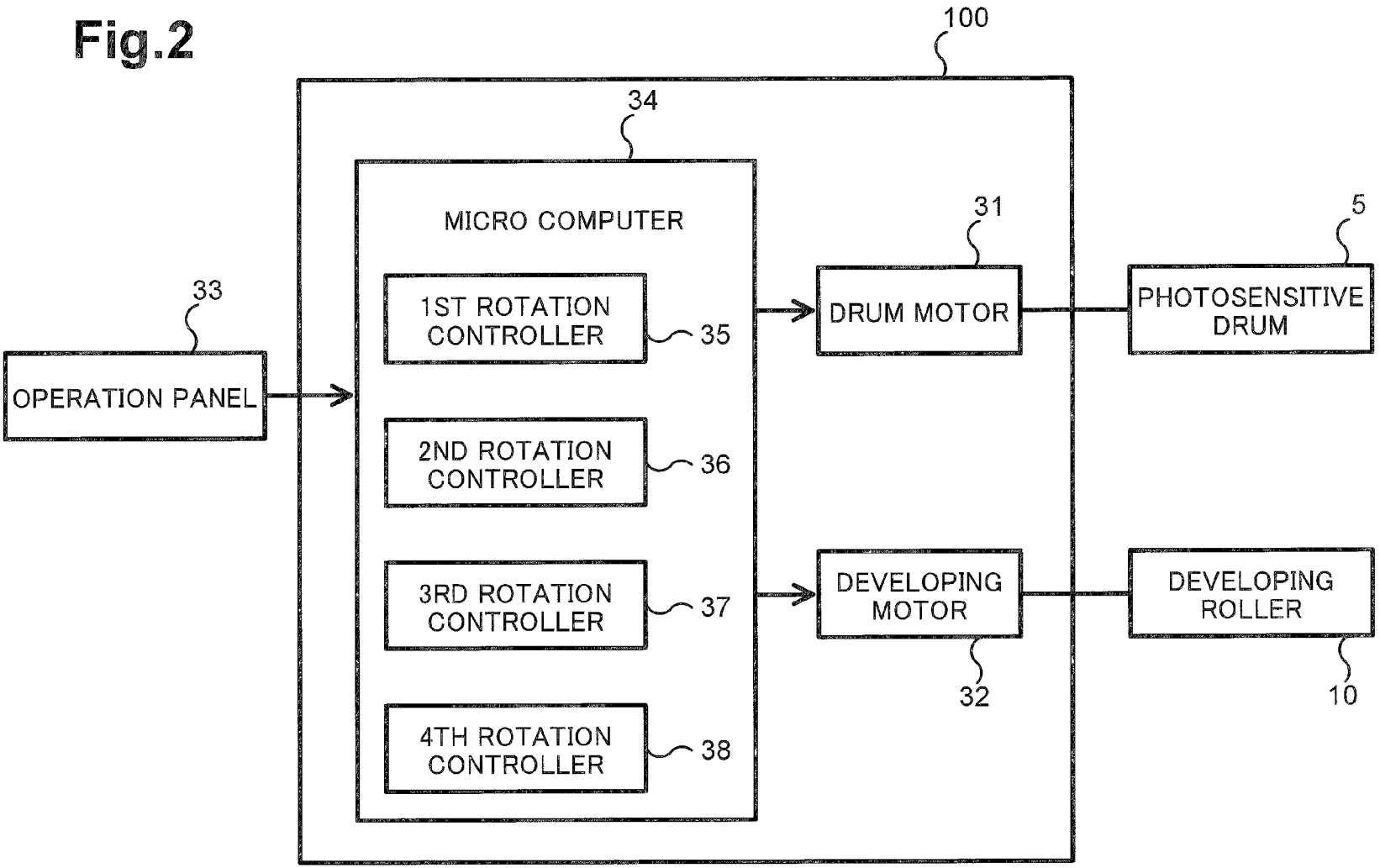
FIG. 2 is a block diagram illustrating an electric structure of the printer.

As shown in FIG. 2, the printer 1 includes an operation panel 33 which is operated by a user to input instructions. The operation panel 33 is disposed on the top surface of the body casing 2.

The printer 1 includes a rotation controller 100. The rotation controller 100 includes a microcomputer 34, a drum motor 31, and a developing motor 32. The rotation controller 100 is configured to control the photosensitive drum 5 and the developing roller 5. Instructions input from the operation panel 33 are given to the microcomputer 34. In addition, image data and various settings set on a personal computer (not shown) connected to the printer 1 are input from the personal computer to the microcomputer 34.

The microcomputer 34 includes CPU and a memory as hardware structure. As a structure realized by software such as programs processed by the CPU, the microcomputer 34 includes a first rotation control unit 35, a second rotation control unit 36, a third rotation control unit 37, and a fourth rotation control unit 38.

The first rotation control unit 35, the second rotation control unit 36, the third rotation control unit 37, and the fourth rotation control unit 38 are configured to control the drum motor 31 and the developing motor 32 for executing a cleaning process for the photosensitive drum 5.

The drum motor 31 is configured to rotate in both forward and reverse directions. Based on the output of the drum motor 31 that rotates in the forward direction, the photosensitive drum 5 rotates in the forward direction (clockwise direction in FIG. 1) which is a rotation direction during development of the electrostatic latent image. On the other hand, based on the output of the drum motor 31 that rotates in the reverse direction, the photosensitive drum 5 rotates in the reverse direction (counterclockwise direction in FIG. 1), which is opposite to the forward direction.

The developing motor 32 is configured to rotate in one direction. Based on the output of the developing motor 32, the developing roller 10 rotates in one direction only, e.g. a forward direction only. In other words, the developing roller 10 is not rotated in a reverse direction. The forward direction of the developing roller 10 is a direction in which the developing roller 10 moves in the same direction as the photosensitive drum 5 at a contact position where the peripheral surface of the developing roller 10 contacts the peripheral surface of the photosensitive drum 5 (refer to FIG. 4, first rotation process, which will be later described). As the developing roller 10 rotates in one direction only, hereinafter the rotation direction of the developing roller 10 is not described unless otherwise specified.

The cleaning process will be described.

In the cleaning process, paper dust and toner adhering to the photosensitive drum 5 are removed from the surface of the photosensitive drum 5. The cleaning process is performed during which image formation is not performed onto a sheet P. The cleaning process may be started when image formation is carried out for a fixed number of times (or a fixed number of sheets P are printed) or when the user inputs the start of the cleaning process on the operation panel 33 or from the personal computer.

Figure 3:
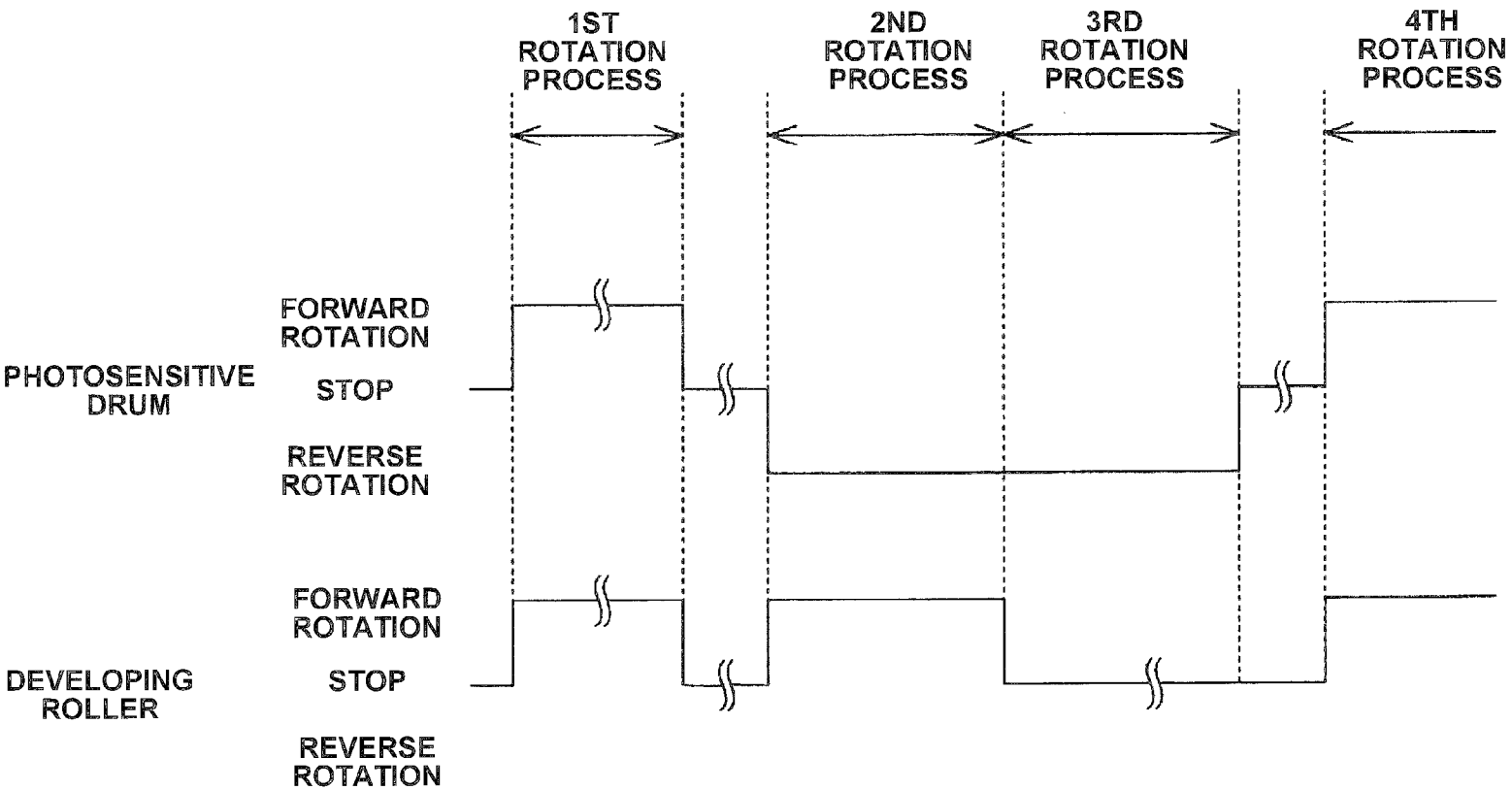
FIG. 3 is a timing chart illustrating control of rotation of a photosensitive drum and a developing roller.
Figure 4:
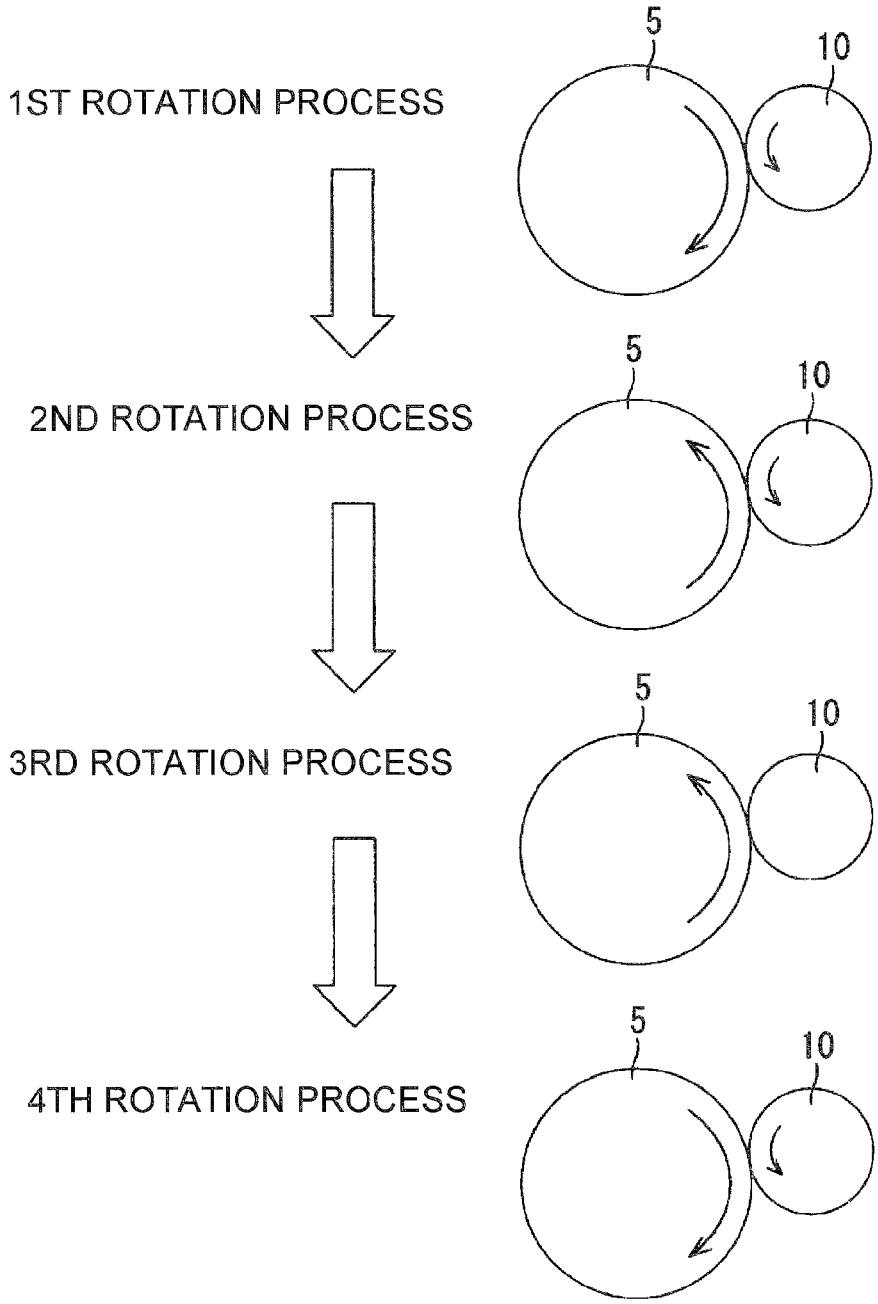
FIG. 4 illustrates operating states between the photosensitive drum and the developing roller according to an illustrative embodiment.

Prior to the start of the cleaning process in the printer 1, the first rotation control unit 35 performs a first rotation process (first step). In the first rotation process, the first rotation control unit 35 controls the drum motor 31 and the developing motor 32 such that the drum motor 31 is driven to rotate in the forward direction, and the developing motor 32 is driven to rotate. Based on the output of the drum motor 31, the photosensitive drum 5 rotates in the forward direction as shown in FIGS. 3 and 4. Based on the output of the developing motor 32, the developing roller 10 rotates as shown in FIGS. 3 and 4. That is, in the first rotation process, the rotation directions of the photosensitive drum 5 and the developing roller 10 are the same as those when a toner image is formed on the surface of the photosensitive drum 5. Thus, the first rotation process is the same as a process in which the toner image is formed on the surface of the photosensitive drum 5. Thus, for the cleaning process, there is no need to add the first rotation process to the process in which the toner image is formed on the surface of the photosensitive drum 5.

In the cleaning process, the second rotation control unit 36 performs a second rotation process (second step). In the second rotation process, the second rotation control unit 36 controls the drum motor 31 and the developing motor 32 such that the drum motor 31 is driven to rotate in the reverse direction, and the developing motor 32 is driven to rotate. Based on the output of the drum motor 31, the photosensitive drum 5 rotates in the reverse direction as shown in FIGS. 3 and 4. Based on the output of the driving motor 32, the developing roller 10 continues to rotate as shown in FIGS. 3 and 4.

At this time, the photosensitive drum 5 and the developing roller 10 move in opposite directions at the contact position where the peripheral surface of the photosensitive drum 5 and the peripheral surface of the developing roller 10 contact each other, and the peripheral surface of the photosensitive drum 5 and the peripheral surface of the developing roller 10 strongly rub against each other. Thus, the peripheral surface of the developing roller 10 rubs against paper dust adhering to the peripheral surface of the photosensitive drum 5, which weakens the adhesion of paper dust to the peripheral surface of the photosensitive drum 5. If there is a filming layer on the peripheral surface of the photosensitive drum 5, the filming layer is scraped when rubbed against by the peripheral surface of the developing roller 10.

The second rotation control unit 36 continues to perform the second rotation process until the photosensitive drum 5 rotates at least one turn in the reverse direction. With this turn, the adhesion of paper dust can be reduced across the entire surface of the photosensitive drum 5 and the filming layer can be scraped.

Then, the third rotation control unit 37 performs a third rotation process (third step). In the third rotation process, the third rotation control unit 37 controls the drum motor 31 and the developing motor 32 such that the developing motor 32 is stopped while the drum motor 31 remains rotated in the reverse direction. Thus, as shown in FIGS. 3 and 4, the photosensitive drum 5 continues to rotate in the reversed direction, and the developing roller 10 stops.

At this time, paper dust whose adhesion to the peripheral surface of the photosensitive drum 5 has been weakened and residues of toner scraped from the filming layer are collected at a position adjacent to the contact position where the peripheral surface of the photosensitive drum 5 and the peripheral surface of the developing roller 10 contact each other, on a upstream side in the reverse rotation direction of the photosensitive drum 5.

The third rotation control unit 37 continues to perform the third rotation process until the photosensitive drum 5 rotates at least one turn in the reversed direction. With this turn, the paper dust and toner on the photosensitive drum 5 can be collected, across the entire surface of the photosensitive drum 5, at the position adjacent to the contact position where the peripheral surface of the photosensitive drum 5 and the peripheral surface of the developing roller 10 contact each other.

Then, the fourth rotation control unit 38 performs a fourth rotation process (fourth step). In the fourth rotation process, the fourth rotation control unit 38 controls the drum motor 31 and the developing motor 32 such that the drum motor 31 is driven to rotate in the forward direction and the developing motor 32 is driven to restart to rotate. Based on the output of the drum motor 31, as shown in FIGS. 3 and 4, the photosensitive drum 5 rotates in the forward direction. Based on the output of the developing motor 32, as shown in FIGS. 3 and 4, the developing roller 10 restarts to rotate. That is, the operations of the photosensitive drum 5 and the developing roller 10 in the fourth rotation process are the same as those in the first rotation process. Thus, the fourth rotation process is identical to the process in which a toner image is formed on the peripheral surface of the photosensitive drum 5. Thus, for the cleaning process, there is no need to add the fourth rotation process to the rotation process in which the toner image is formed on the peripheral surface of the photosensitive drum 5. As an image is formed on the sheet P after the third rotation process, the performance of the fourth rotation process is automatically accomplished.

By rotation of the developing roller 10 in the fourth rotation process, the paper dust and the residues of toner, which are collected at the position adjacent to the contact position where the peripheral surface of the photosensitive drum 5 and the peripheral surface of the developing roller 10 contact each other, are carried onto the peripheral surface of the developing roller 10, and brought to a downstream side of the developing roller 10 in its rotation direction. The paper dust and the residues of toner are collected in the developer casing 9.

When a filming layer is present on the peripheral surface of the photosensitive drum 5, not only the filming layer is scraped, but also the residues of toner generated after scraping can be effectively removed from the peripheral surface of the photosensitive drum 5. In addition, paper dust can be effectively removed from the peripheral surface of the photosensitive drum 5.

Figure 5:
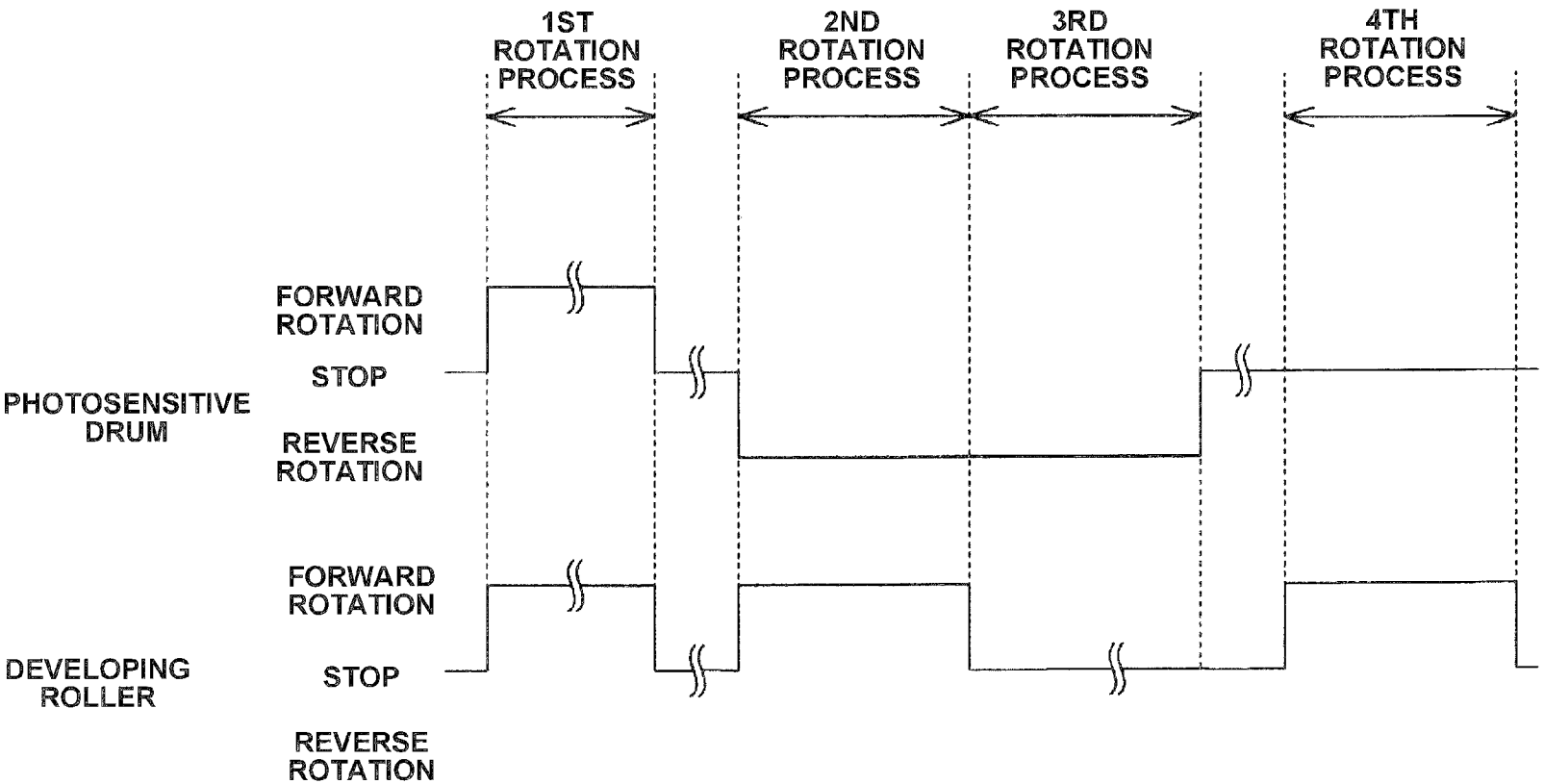
FIG. 5 is a timing chart illustrating control of rotation the photosensitive drum and the developing roller according to an illustrative embodiment.

The fourth rotation process may be different from the process in which the toner image is formed on the peripheral surface of the photosensitive drum 5. In the fourth rotation process, for example, the fourth rotation control unit 38 may control such that the drum motor 31 may be stopped, while the developing motor 32 may be driven to rotate. Thereby, as shown in FIG. 5, the photosensitive drum 5 may stop and the developing roller 10 may restart to rotate.

Figure 6:
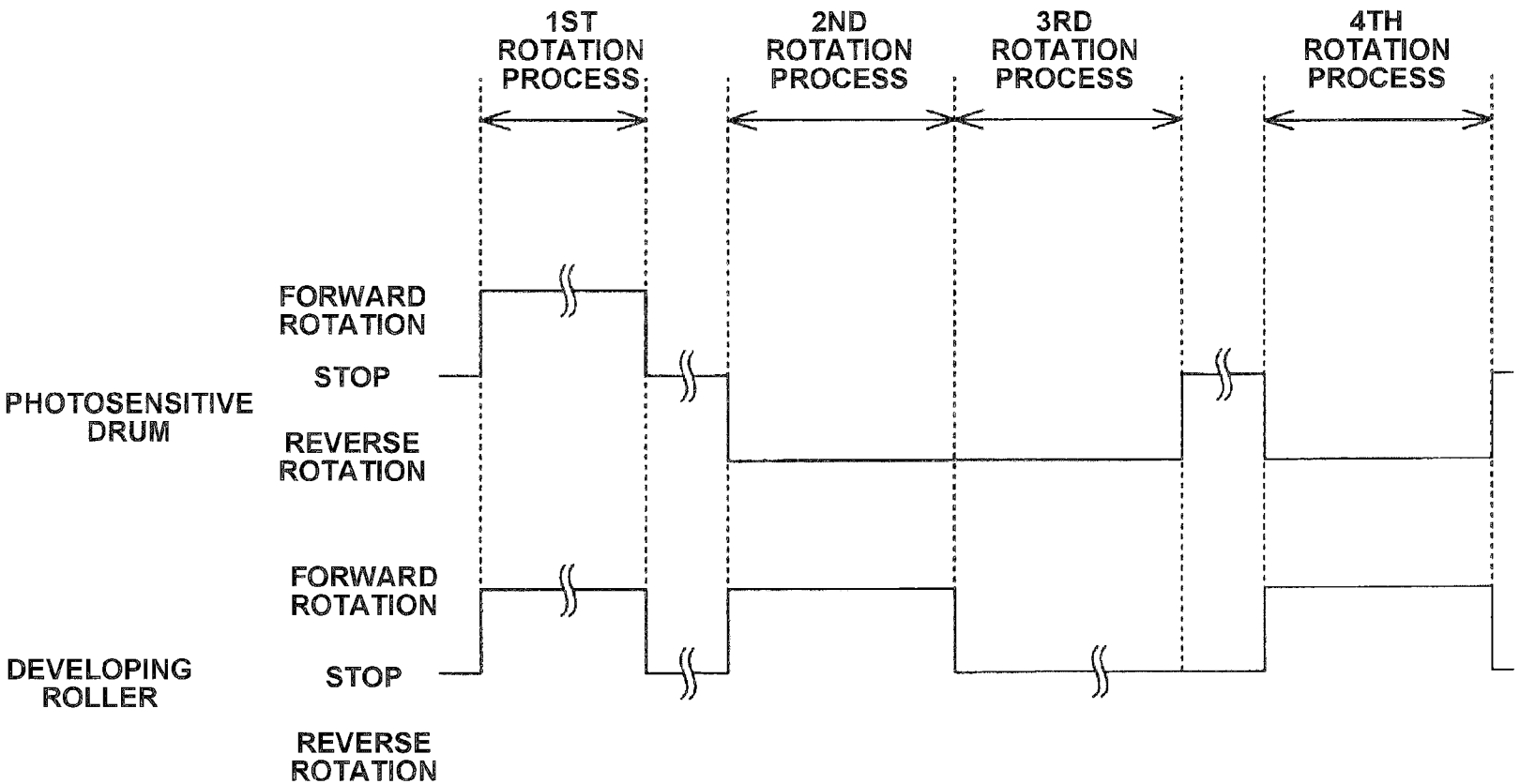
FIG. 6 is a timing chart illustrating control of rotation the photosensitive drum and the developing roller according to an illustrative embodiment.

Alternatively, in the fourth rotation process, the fourth rotation control unit 38 may control such that the drum motor 31 may be driven to rotate in the reverse direction and the developing motor 32 may be driven to rotate. Thereby, as shown in FIG. 6, the photosensitive drum 5 may rotate in the reverse direction and the developing roller 10 may restart to rotate.

The illustrative embodiment shows, but the disclosure is not limited to, a monochrome printer. Instead, a color printer may be used.

While the features herein have been described in connection with various example structures and illustrative aspects, it will be understood by those skilled in the art that other variations and modifications of the structures and aspects described above may be made without departing from the scope of the disclosure described herein. Other structures and aspects will be apparent to those skilled in the art from a consideration of the specification or practice of the features disclosed herein. It is intended that the specification and the described examples only are illustrative with the scope of the inventions being defined by the following claims.

What is claimed is:

1. An image forming apparatus configured to form an image on a recording medium with a developer, the image forming apparatus comprising:

a photosensitive drum;

a developing roller disposed such that a peripheral surface thereof contacts a peripheral surface of the photosensitive drum, the developing roller being configured to supply the developer to the peripheral surface of the photosensitive drum;

a rotation controller configured to execute the steps comprising:

(a) controlling the photosensitive drum and the developing roller such that the developing roller rotates in a predetermined direction and the photosensitive drum rotates in a forward direction in which a peripheral surface of the photosensitive drum moves in a same direction as the peripheral surface of the developing roller at a contact position where the peripheral surface of the photosensitive drum contacts the peripheral surface of the developing roller;

(b) controlling the photosensitive drum and the developing roller, after the step of (a), such that the developing roller continues to rotate in the predetermined direction and the photosensitive drum rotates in a reverse direction which is opposite to the forward direction;

(c) controlling the photosensitive drum and the developing roller, after the step of (b), such that the developing roller stops and the photosensitive drum continues to rotate in the reverse direction; and (d) controlling the developing roller, after the step of (c), such that the developing roller restarts to rotate in the predetermined direction.

2. The image forming apparatus according to claim 1, wherein the step of (d) includes controlling the photosensitive drum, after the step of (c), such that the photosensitive drum rotates in the forward direction.

3. The image forming apparatus according to claim 1, wherein the step of (d) includes controlling the photosensitive drum, after the step of (c), such that the photosensitive drum stops.

4. The image forming apparatus according to claim 1, wherein the step of (d) includes controlling the photosensitive drum, after the step of (c), such that the photosensitive drum rotates in the reverse direction.

5. The image forming apparatus according to claim 1, wherein each of the steps of (b) and (c) includes controlling the photosensitive drum such that the photosensitive drum rotates at least one turn in the reverse direction.

6. The image forming apparatus according to claim 1, wherein the step of (a) includes controlling the photosensitive drum and the developing roller such that a developer image is formed on the peripheral surface of the photosensitive drum with the developer supplied by the developing roller.

7. A method of cleaning a peripheral surface of a photosensitive drum in an image forming apparatus, the image forming apparatus comprising a rotation controller, the photosensitive drum, and a developing roller, the developing roller being disposed such that a peripheral surface thereof contacts a peripheral surface of the photosensitive drum, the developing roller being configured to supply a developer to the peripheral surface of the photosensitive drum, the method comprising the steps of:

(a) controlling, by the rotation controller, the photosensitive drum and the developing roller such that the developing roller rotates in a predetermined direction and the photosensitive drum rotates in a forward direction in which a peripheral surface of the photosensitive drum moves in a same direction as the peripheral surface of the developing roller at a contact position where the peripheral surface of the photosensitive drum contacts the peripheral surface of the developing roller;

(b) controlling, by the rotation controller, the photosensitive drum and the developing roller, after the step of (a), such that the developing roller continues to rotate in the predetermined direction and the photosensitive drum rotates in a reverse direction which is opposite to the forward direction;

(c) controlling, by the rotation controller, the photosensitive drum and the developing roller, after the step of (b), such that the developing roller stops and the photosensitive drum continues to rotate in the reverse direction; and (d) controlling, by the rotation controller, the developing roller, after the step of (c), such that the developing roller restarts to rotate in the predetermined direction.

8. The cleaning method according to claim 7, wherein each of the steps of (b) and (c) includes controlling the photosensitive drum such that the photosensitive drum rotates at least one turn in the reverse direction.

9. The cleaning method according to claim 7, wherein the step of (a) includes controlling the photosensitive drum and the developing roller such that a developer image is formed on the peripheral surface of the photosensitive drum with the developer supplied by the developing roller.

* * * * *